United States Patent [19]

Ryan

[11] 4,389,063

[45] Jun. 21, 1983

[54] REUSABLE TAMPER-INDICATING SECURITY SEAL

[75] Inventor: Michael J. Ryan, Plainfield, Ill.

[73] Assignee: The United States of America as represented by the United States Department of Energy, Washington, D.C.

[21] Appl. No.: 276,611

[22] Filed: Jun. 23, 1981

[51] Int. Cl.[3] ..... B65D 33/34

[52] U.S. Cl. ..... 292/307 R; 283/81; 283/93; 283/99; 283/114; 40/626; 40/914

[58] Field of Search ..... 292/252, 307 R, 325; 283/9 R

[56] References Cited

U.S. PATENT DOCUMENTS

| | | | |
|---|---|---|---|
| 2,361,670 | 10/1944 | Whitehead | 283/9 R X |
| 3,221,428 | 12/1965 | Fischler et al. | 292/307 R X |
| 3,864,855 | 2/1975 | Pekko et al. | 292/307 R X |
| 4,118,057 | 10/1978 | Ryan | 292/307 R |
| 4,298,217 | 11/1981 | Morau et al. | 283/9 R X |

*Primary Examiner*—Richard E. Moore

[57] ABSTRACT

The invention teaches means for detecting unauthorized tampering or substitutions of a device, and has particular utility when applied on a "seal" device used to secure a location or thing. The seal has a transparent body wall, and a first indicia, viz., a label identification is formed on the inside surface of this wall. Second and third indicia are formed on the outside surface of the transparent wall, and each of these indicia is transparent to allow the parallax angled viewing of the first indicia through these indicia. The second indicia is in the form of a broadly uniform pattern, viz, many small spaced dots; while the third indicia is in the form of easily memorized objects, such as human faces, made on a substrate by means of halftone printing. The substrate is lapped over the outside surface of the transparent wall. A thin cocoon of a transparent material, generally of the same material as the substrate such as plastic, is formed over the seal body and specifically over the transparent wall and the second and third indicia formed thereon. This cocoon is seamless and has walls of nonuniform thickness. Both the genuineness of the seal and whether anyone has attempted to compromise the seal can thus be visually determined upon inspection.

17 Claims, 8 Drawing Figures

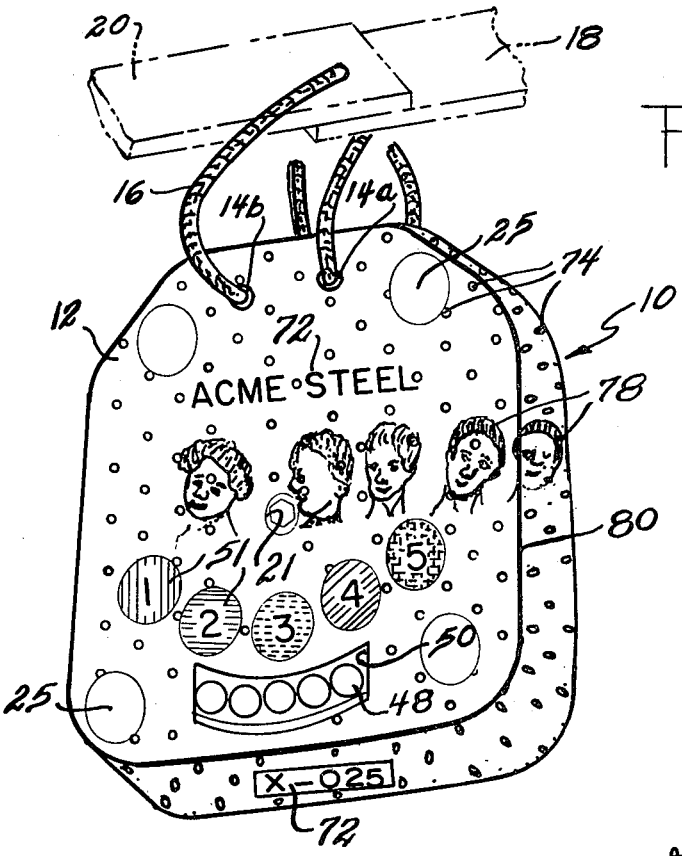
FIG 1
FIG 2
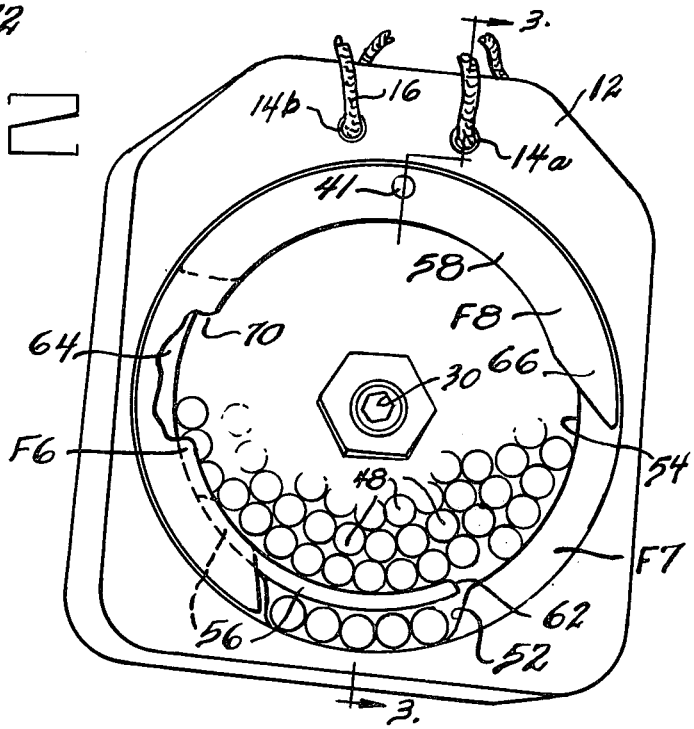

FIG 5
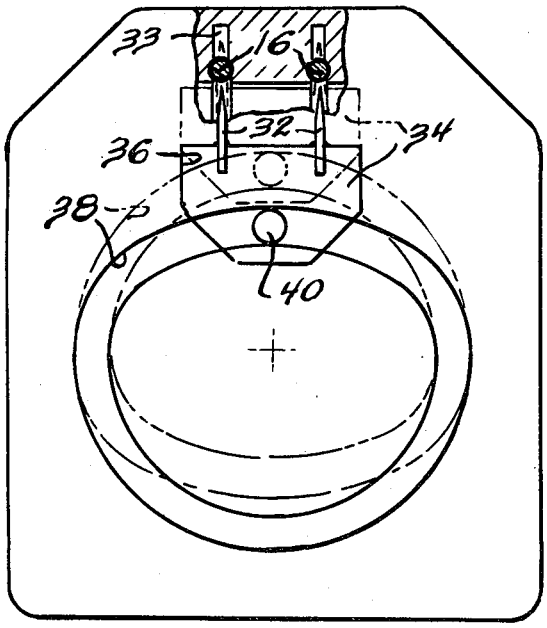
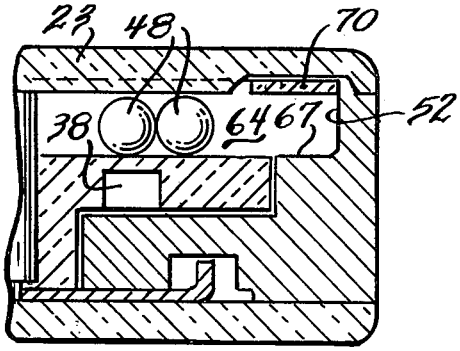
FIG 6
FIG 7
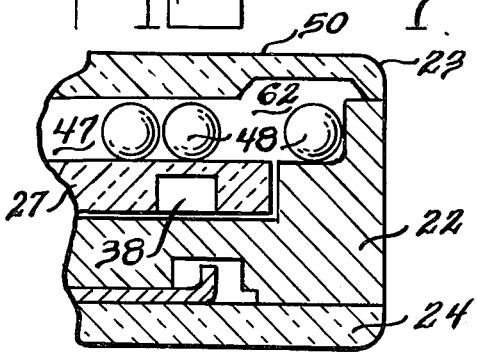
FIG 8
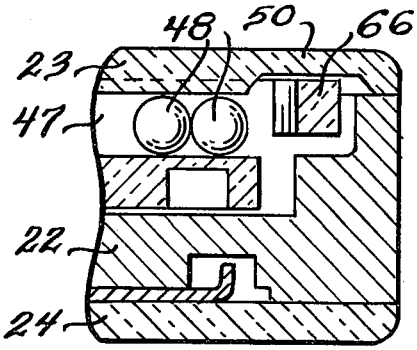

REUSABLE TAMPER-INDICATING SECURITY SEAL

CONTRACTUAL ORIGIN OF THE INVENTION

The U.S. Government has rights in this invention pursuant to Contract No. W-31-109-ENG-38 between the U.S. Department of Energy and Argonne National Laboratory.

BACKGROUND OF THE INVENTION

A strong need exists for a reusable, high-security, tamper-indicating seal for safeguarding valuable components or material. This may include, for example, nuclear fuel stored in special canisters that are closed and secured, where the canisters are then kept in a secured room. A seal is placed on the secured canister and/or on the door to the room by an authorized secuity agent. A seal is distinguished from a lock in that it can be easily defeated to provide unauthorized access to the secured material. The main function of a seal is to provide indication whether anyone has tampered with or otherwise has had access to the secured material once it had been secured by the seal.

U.S. Pat. No. 4,118,057 discloses such a security seal. The patented seal utilizes a cable that can be looped through a locking mechanism of the confinement that is to be secured, and a seal body which defines a pair of openings through which the opposite ends of the cable can then be fed. The seal further has a mechanism therein for mechanically engaging the cable so as to preclude the separation of the cable from the seal. As long as the looped cable remains intact and secured to the seal, the locking mechanism cannot be operated. Also located within the seal is a coding arrangement consisting of many balls of different colors, where a random grouping of the balls is segregated when the seal has been set in place and is visible such as through a window in the seal. The color-sequence code, although randomly generated, would be unique to that seal for that setting. The seal can be opened by means of a standard Allen wrench or even a screwdriver, but the code is destroyed each and every time the seal is opened. Having once been opened, the seal would have generated a new random code when it was subsequently reset. Consequently, were anyone to attempt to open and reset the seal undetected, the chances of the same code being generated would be as remote as the permutation of randomness provided by the seal and its code system.

However, the patented seal might be defeated by completely removing it and replacing it with a counterfeit. In other words, the genuineness of the seal itself can be put in doubt, where a substitute seal could be put in place of the original and a security agent may not be alerted that something of this nature has happened. Further, where a number of similar seals are in common use, it is possible to selectively destroy the various seals and restructure from these various component parts a single counterfeit seal that would appear to be genuine. Also, the seal could be opened without disturbing the code, such as by selective drilling through the seal to release the cable; and it might be somewhat difficult without this fact being of prime concern to detect this false entry. It is possible therefore to frustrate the intended purpose of the patented seal by any of several ways not related to the random code and its uniqueness.

SUMMARY OF THE INVENTION

This invention provides an improved reusable, tamper-indicating, high-security seal that would visually indicate unauthorized access to a secured location or to secured goods.

A primary feature of this invention is that the variable code is not only randomly generated each time the seal is operated but the code is determined only after the seal has been set or locked in place on the secured material and therefore this new code information is kept unknown and/or secret until after the seal has been completely secured.

This invention also incorporates various techniques for verifying the genuineness or authenticity of the seal in question, so as to preclude the undetected attempted substitution of another seal for the genuine seal.

The invention provides a cocoon of a seamless transparent plastic material over the seal, which gives evidence of the continuous integrity of the seal in that any attempted destruction of this cocoon can be visibly detected quite readily.

The invention further provides selective indicia, applied on the seal before the encapsulating cocoon is formed, which can be visually inspected to determine whether the seal has been tampered with and/or is genuine. One indicia is made on the exterior surface of the seal body and preferably is in the form of uniformly-spaced small dots. Another indicia is made on a transparent band placed over the small dot indicia, and this indicia preferably is in the form of human faces. All seals made for or used by a common security agent would have identical images of dots, human faces, etc., so that they can be readily memorized to serve as a basis of genuineness.

This invention further provides various means of checking for the authenticity of the small dot and human face indicia. The human face indicia, for example, is formed with a halftone printing process comprised of a multitude of small dots, so as to be transparent in part even for the darkest area of the human face. Consequently, all the underlying small dot indicia remain visible in varying degrees beneath the human face indicia.

An even more subtle means of proving the genuineness of the seal provides that at least one of the seal corners would be radiused and that the two indicias mentioned would be continued over this curved surface. Consequently, attempted regeneration of these curved and shaped images by photography means or by other simulated means would be extremely difficult.

Moreover, at least one wall of the seal body would be formed of a transparent material so as to allow the formation of yet a third indicia on the inner surface of the wall. Consequently, this indicia would be visible through both the small dot and human face indicia, and a parallax would occur as between these various indicias as they are viewed from varying angles. This third indicia can be printed in the form of an informational or identifying label.

This invention provides even further that the material of substrate on which the human face indicia is printed is similar to the material forming the cocoon. This means that when the cocoon is applied over the seal body and this printed human face indicia, the indicia is actually transferred onto the inner face of the cocoon. Also, the overlying cocoon is formed with nonuniform wall thicknesses. Consequently, attempted destruction of the cocoon such as by acid, solvents or the like cannot be easily achieved since the thinner wall sections would be destroyed before the thicker wall section, and this would distort or obliterate the human face indicia underlying the destroyed thinner wall sections.

DETAILED DESCRIPTION OF THE DRAWINGS

FIG. 1 is a perspective view of a preferred embodiment of the inventive seal, showing it schematically in operative association securing apparatus;

FIG. 2 is a perspective view of the seal of FIG. 1, except showing it without the cocoon overwrap and indicia, and also with some structure partially broken away so as to illustrate the coding construction of the seal;

FIG. 5 is an elevational view, partly in section as seen generally from line 5—5 in FIG. 3, so as to illustrate the locking mechanism of the seal, and FIGS. 6, 7 and 8 are partial sectional views similar to FIG. 3, except as seen with the seal in various operative positions, specifically where:

FIG. 6 is a view where the seal drum has been rotated to bring the drum location F6 (see FIG. 2) to the section line 3—3 at pocket 52;

Figure 3:
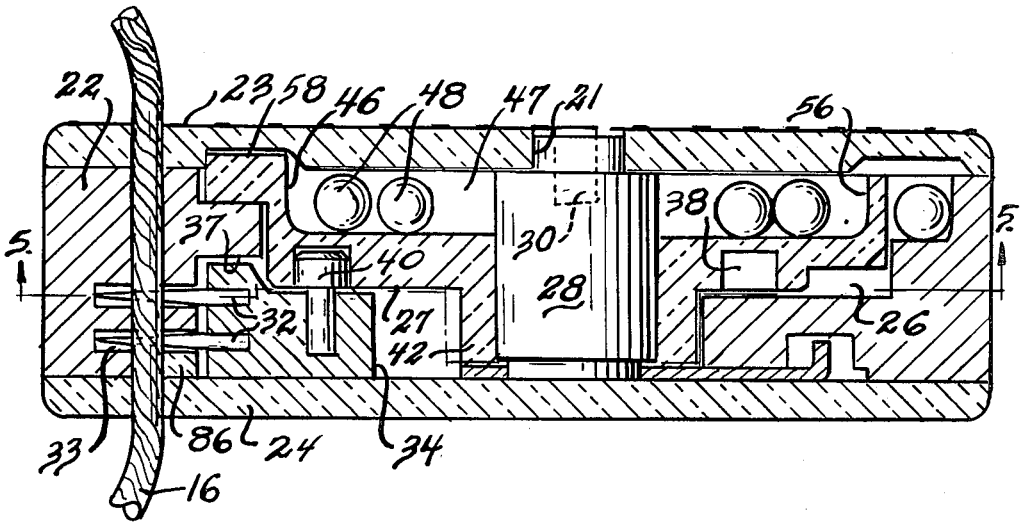
FIG. 3 is a sectional view, as seen generally from line 3—3 in FIG. 2, showing additional details of construction of the seal.

FIG. 7 is a view where the seal drum has been rotated to bring the drum location F7 to the section line 3—3 at pocket 52; and FIG. 8 is a view where the seal drum has been rotated to bring the drum location F8 to the section line 3—3 at pocket 52.

DETAILED DESCRIPTION OF THE INVENTION

In FIG. 1, a seal 10 is seen to comprise a body 12 having a pair of openings **14*a* and 14*b* through which a cable 16 can be fed when the seal is set in place. The cable 16 is extended from the opening 14*a* back as a loop through aligned openings in a pair of clasp members 18 and 20 which are to be secured together in a closed position and back through the opening 14*b*. In this configuration, it will be apparent that the cable 16 as looped through the clasps 18 and 20 prohibits separation of the clasps. Any type of securing clasp or locking mechanisms 18 and 20** is possible, that shown being merely illustrative of the principle involved that would prevent access to goods or location (neither being shown) secured by the clasps.

A key (not shown) would be used to operate the seal 10, to release the cable 16 from engagement with the seal body 12 and likewise to set the cable 16 in place within the seal body. The key would be conventional and simple, such as an Allen wrench or alternatively even a flat blade screwdriver (neither being shown), and would be fitted into opening 21 to engage the underlying operative mechanism.

The seal body 12 includes a central housing 22 (see FIG. 3), a front cover 23 and a rear cover 24 sandwiching the housing 22, and securing pins (not shown) at locations 25 (see FIG. 1) holding these components together. The housing 22 is somewhat annularly shaped to form a central hollow 26 (see FIG. 3); and a disc-like cylindrical drum member 27 is fitted in this hollow. The drum 27 is secured by a centrally located one-way clutch mechanism 28 relative to the body housing 22 so as to rotate only in a clockwise direction as referenced in FIGS. 1 and 2 relative to the seal body 12. The key (not shown) is designed to fit through opening 21 in the front wall 23 into a cooperating opening 30 (FIG. 2) in the drum 27 so as to allow manual rotation of the drum between its various operative positions.

The means for locking the cable 16 relative to the seal 10 is illustrated in FIGS. 3 and 5, and includes pins 32 which move within bores 33 of the housing 22 crosswise of the cable openings **14*a* and 14*b* so as to pierce the cable 16. The pins 32 are secured to a carrier 34 that is guided by parallel walls 36 of the seal housing 22 and by housing wall 37 and the inside surface of the rear cover 24. As shown, two pins 32 are used to pierce the cable 16 within each of the openings 14*a* and 14*b***.

The backside of the drum 27 has a continuous cam track 38 formed therein (see FIGS. 3 and 5) and a cam follower 40 secured to the carrier 34 fits in the track 38 and is moved thereby. The cam track 38 is generally circular in contour about the clutch mechanism 28, which forms the rotational axis of the drum 27, throughout about two quadrants, and is angled in closer to the center axis throughout the remaining two quadrants. Consequently, one complete rotation of the drum 27 will operate the seal through one locking and unlocking cycle. FIG. 5 shows the seal opened, where the pins 32 are clear of the cable openings **14*a* and 14*b* so that the cable 16 can be freely removed from the openings or inserted through the openings. For 90° of drum rotation before this position, the seal is opening; whereas for 90° of drum rotation after this position, the seal is locking. FIG. 2 shows the seal in the set position, 180° out of phase from the open position of FIG. 5. In the seal-opened position, a mark 41 (FIG. 2) on the drum would thus be visible through seal window 50 (see FIG. 1). The set position of the seal is illustrated in phantom in FIG. 5. Preferably, a detent (not shown) is releasably biased in a radial direction against hub 42 (FIG. 3) of the drum 27** so as to hold the drum in its opened and closed operative positions.

The disclosed seal 10 also generates a random code when it is set in place. In this regard, the drum 27 is dished out on its front as at 46 (see FIG. 3) to define a cavity 47 with the front cover 23 for holding therein a plurality of separate balls 48 (see FIG. 2). In the proposed combination there are five different colored balls (red, blue, silver, green and yellow, for example) represented in the group, and perhaps twelve balls of each color for a total ball count of sixty. When the seal is to be set in place, five of these balls are randomly taken from the large group and held in a sequence that is visible through transparent window 50 (see FIGS. 1 and 3) in the front cover 23. This would allow 3,125 different combinations (a permutation of five to the fifth power) that can be achieved with the balls arbitrarily falling in the order noted by code positions 51 identified by the indicia "1," "2," "3," "4" and "5" in FIG. 1. Operation of the seal would code the balls randomly every time the seal would be set, to provide a unique identification of the seal 10 and code. Also, with a numerical coding of the colored balls, for example, where red might be "1," blue might be "2," silver might be "3," green might be "4," and yellow might be "5," a digital code could also be identified from the ball sequence. The background of the numbered code positions 51 can be colored to correspond to this digital color code to minimize the need to memorize the code.

The balls 48 are free to move about in a random fashion within the drum cavity 47. The housing 22 adjacent the outer edges of the cavity has a pocket 52 (see FIGS. 2, 3, 6, 7 and 8) cut out from the normally cylindrical wall 54 defining the dished out opening 26 so that the balls 48 can move into this pocket 52. The pocket 52 is sized so that only five of the balls 48 can fit in it at one time; or looking at it another way, it extends along an arc only about 30°–45° long relative to the rotational axis of the drum.

Cylindrical wall sections 56 and 58 are formed on the drum 27 and define the radial confines of the cavity 47. These wall sections 56 and 58 extend almost all the way around the drum 27, leaving only two gaps 62 and 64 each throughout a short distance just slightly in excess of the arc length of the pocket 52. One wall section 56 is relatively thin (see FIGS. 2 and 3) and lines up opposite the pocket 52 when the seal is secured to keep the balls in the pocket, and arcs a nearly equal distance ahead of the pocket. The gap 62 is located immediately after this wall section 56 (see FIGS. 2 and 7). The wall section 58 is extended radially beyond housing wall 54 and immediately follows the gap 62. The lead end of the wall section 58 is wedge shaped as at 66 in the nature of a plow (see FIGS. 2 and 8). The plow is located slightly beyond midway of the balls in the pocket 52 toward housing wall 67. The plow 66 wedges any balls in the pocket out of the pocket through gap 62. The gap 64 is located just ahead of restraining wall 56 (see FIGS. 2 and 6) and allows the balls in the cavity to fall into the pocket 52.

A radial wall 70 (see FIGS. 2 and 6) is bridged over the gap 64 between the wall sections 56 and 58 and also over the first part of the radial wall 56. This wall 70 is spaced from housing wall 67 sufficiently so as to allow the balls 48 to fit between the walls into and/or out of the pocket 52. This radial wall 70 is opaque, and acts as a shutter that hides the balls 48 in the pocket 52 when this wall part 70 is over the pocket. Under such circumstances, when gap 64 initially lines up with pocket 52, a random group of five balls enters the pocket and defines the code, but this code is hidden from view by wall 70 and thus remains secret. Continued drum rotation moves drum wall 56 across the pocket 52 to trap and retain these coded balls in the pocket, while the shutter yet hides the coded balls; and it is only after the seal is secured and the code is set that the shutter wall 70 moves from the pocket to expose these balls.

Consider now a typical sequence of operation, starting from a condition where the seal is open (FIG. 5). A new cable 16 is fed through the body opening **14*a*, intertwined as a tight loop with the securing clasps 18 and 20, and backfed through the opposite opening 14*b*. During the first quarter turn of the drum 27, the pin carrier 34 is shifted radially via the cam track 38 to force the pins 32 through the cable for securing the cable relative to the seal 10**.

During the next quarter turn the balls 48 are allowed to fill the ball retaining pocket 52 via the gap 64 in the drum wall to set a randomly determined code. However, during the initial stages of this drum rotation, opaque radial wall 70 prevents viewing of the coded balls in the pocket through the window 50. However, the last portion of this last quadrant of drum rotation moves the opaque shutter wall 70 out of the way of the pocket 52 to expose the coded balls through the viewing window 50. This code is specific and will remain the same until the seal is next opened. Any change in this code thus can be used to identify if and when the seal has been opened.

To open the seal, the first quarter turn of the drum 27 moves the ball holding drum wall 56 clear of the pocket to line up gap 62 with the pocket 52 and the balls are swept out of the pocket by the plow 66 so that the code is destroyed. The next quarter turn moves the pin carrier 34 radially inwardly to release the pins 32 from engagement with the cable 16 effective then to open the seal 10. The cable 16 can then be removed from the seal 10 and access is provided to the securing clasps 18 and 20. The detent holds the drum in this position, and the indicia 41 on the drum can be used as a visual indicator that the seal is in this position.

The seal 10 is designed as an tamper-indicating device. As such, it is not intended that the cable 16 be tempered or otherwise hardened to preclude against possible forced entry by cutting the cable. Instead, the seal is merely intended to illustrate whether someone has tampered with the seal after it had been originally set in place by an authorized security agent. Along these lines, the improved seal 10 has many modes of detection, including varying indicia that are formed on the body 12 of the seal 10.

Figure 4:
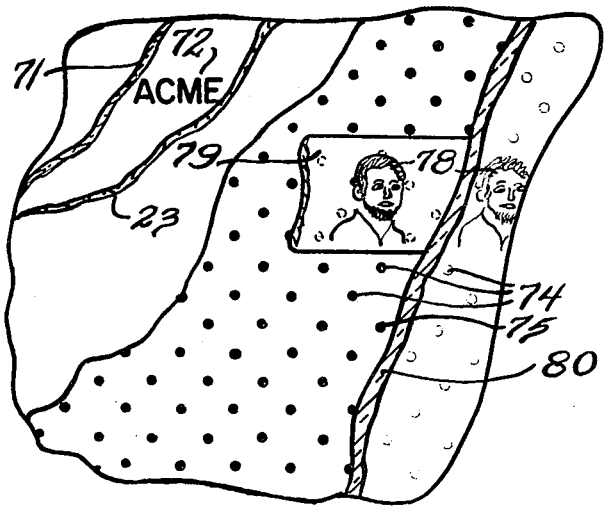
FIG. 4 is a perspective view of one wall of the seal, showing the various indicia and cocoon overwrap thereon in a peeled away format for clarity of disclosure.

In the first place, at least some of the seal walls, including front wall 23, are transparent so that a label 71 (see FIG. 4) having indicia 72 on the front face thereof can be bonded to the inner surface of the transparent wall and yet have the indicia externally visible. This indicia 72 might identify the company and/or the seal number such as Acme Seal on the front wall, and X-025 on the bottom wall as indicated in the FIG. 1.

Located on the exterior surface of the seal body would be another form of indicia 74, which in a preferred embodiment, would be a pattern of small spaced marks such as dots 75. This indicia 74 preferably would be applied uniformly over virtually the entire exterior of the seal body 12, as for example, by vapor deposition of aluminum. With this technique, the body is masked with a perforated barrier and placed in a chamber that is evacuated. An aluminum foil is then vaporized and the vapor migrates through the holes in the perforated mask and adheres to the seal body. Being of aluminum, the dot pattern indicia 74 has a reflectiveness that even further highlights the uniformity of the pattern, to the end that any discontinuity or break in the pattern becomes readily apparent.

Located over the uniform indicia 74 would be yet another indicia 78. The indicia 78 might be printed on the outside surface of a band 79 of transparent plastic material, for example. The plastic band 79 can entirely enwrap the exterior body 12 of the seal including going around a rounded corner 80. The indicia 78 is preferably formed by a halftone printing process, which means it is comprised of a plurality of very tiny dots (too small to be shown) at varying spacings relative to one another to give the contrast or form to the picture. By intentionally limiting the spacing of the dots, the indicia 78 yet retains a transparency even in the darkest part of the picture. Consequently, one can see completely through the indicia 78 to detect the underlying dot pattern indicia 74 and label indicia 72. The indicia 78 is preferably in the form of human faces, which are highly distinctive but yet can be easily memorized.

A transparent material would totally enclose the body 12 of the seal 10 except for the cable openings 14*a* and 14*b* and the key opening 21. These openings can be plugged during the encapsulating procedure. To form the cocoon 82, the entire seal body 12 may be dipped, for example, in liquid plastic. This also renders the plastic cocoon 82 seamless and the cocoon covers the entire exterior of the seal and the various indicias 72, 74 and 78 previously discussed. The cocoon 82 can also be injection molded or cast over the seal body.

In a preferred embodiment, the band 79 on which the indicia 78 is printed is of a material similar to the material of the cocoon 82. The seal body itself is also formed of a similar material. This means that during the formation of the cocoon 82 the printed indicia 78 is imparted in part to the inner face of the cocoon. Consequently, the cocoon 82 itself thereby takes on the indicia. The significance of this is that should anyone attempt to peel away the cocoon 82, the printed indicia 78 will in part go with the destroyed cocoon, thereby rendering it extremely difficult to reassemble a new cocoon over the old images.

In a preferred embodiment, the cocoon 82 as put on has nonuniform wall thickness. Thus, even with chemical or solvent etching, it would be quite difficult to remove the cocoon 82 since the thinner wall sections would be removed first and would subsequently then allow part of the underlying indicia 78 on band 79 to be removed before even all of the cocoon were removed.

The significance of the indicia 72, 74 and 78 and the overwrap cocoon 82 can be noted as follows. The label indicia 72, being on a plane spaced inwardly through a transparent front cover 23 from the dot pattern indicia 74 and the face indicia 78 will create a parallax upon angled viewing of the seal. Thus, the apparent locations of the dots and face will move relative to the label indicia 72 as the viewing angle changes. Of significance also is the fact that the dot indicia 74 and the face indicia 78 each is present around a corner 80 on the edge of the seal body. This presents varying images from different frontal or corner angle views. Consequently, this combination of three-dimensional indicia cannot be easily copied by photographic means since any attempt to do so would not truly portray the three-dimensional image or the parallax condition.

Also, inasmuch as the cocoon 82 is seamless, transparent, and totally encloses the seal 10, it would be extremely difficult to destroy the cocoon 82 for opening the seal 10 and then to reapply the cocoon without any detectable gaps or discontinuities being noted. Further, the attempted removal of the encapsulating cocoon 82 would destroy the uniformity of the face indicia 78 so as to make it readily apparent that some tampering has taken place. Moreover, the face indicia 78 can be easily memorized, so that a security inspector can be trained to recognize the indicia to the end that any attempted seal substitution could be readily detected. All seals to be used by a single agency would have identical seals, and all indicia except for specific seal identification would be identical.

The cable 16 itself is preferably braided from many very fine individual wires. The cable might, for example, be 1/16th of an inch in diameter, formed by thirty-two smaller wires. Also, sixteen of the wires can be of stainless steel and sixteen of the wires can be of copper that is tin coated to look like stainless. The cable 16 has a uniform braid so that when the seal 10 is set and the locking pins 32 are driven through the cable, the resulting holes (not shown) can be seen when the cable is later removed. Thus, any attempt to drill the cable and the pins out, and to reassemble the seal with a new cable that would be merely held in the seal body with a barb or the like, can be readily detected. In this regard, the seal body at the front cover 23 or at the rear cover 24 preferably is transparent as at window area 86 (see FIG. 3) adjacent the locking pins. This allows visual viewing of these components and examination to see if the pins 32 actually engage the cable. Also, the operation of the seal will determine whether the pins 32, in fact, release the cable 16 so that the cable can be pulled out. The cable can then also be examined for holes or discontinuity of braid to determine if the cable had been compromised.

One specific example of the dot indicia 74 would be circular dots each approximately 0.5 mm in diameter spaced apart with a uniform density of 60 dots per $cm^2$. This gives an approximate opacity of 18% and a transparency of 82%. By varying the size and spacing of the marks, this transparency percentage can be changed, but should be maintained in the range of approxiamately 70–90%. The pattern can be uniform, which highlights when any discontinuity or break in the pattern occurs. This thereby provides that a security agent can easily detect any discontinuity visually, so that a more stringent check can be made of the seal for genuineness or other evidence of tampering. However, a random fleck pattern applied over virtually the entire seal body can work also, since any discontinuity in the pattern again can be easily detected. Also, while circular dots are illustrated, the marks can be of any other shape.

The subject invention can function without external electric or battery power, without special set up or sensing tools or apparatus, and without the need for expensive or complicated technology.

Of interest also is the general concept of indicia coding and the subsequent encapsulation of bodies other than a seal-type device where the general purpose would be to detect unauthorized use of the body itself. Thus, an electric switch (not shown) controlling the operation of a specific device, such as a computer, might be indicia coded and encapsulated to prevent undetected use of the device via actuation of the switch. Also, a camera or tape recorder could be loaded with film or tape and set for operation, but secured closed and sealed, etc. to detect unauthorized tampering or removal of the film or tape. The invention thus broadly provides for a reliable, economical and visual means of detecting when and if a substitute has been put in place of the original or if the original had been compromised for unauthorized use.

The embodiments of the invention in which an exclusive property or privilege is claimed are defined as follows:

1. A seal combination for detecting unauthorized tampering or substitution of a secured item, the improvement comprising the seal combination having a transparent wall, a first indicia disposed on the inside surface of the transparent wall, a second indicia provided over virtually all of the outside surface of the transparent wall, said second indicia having a uniformity such that any variation in the uniformity can readily be detected, a third indicia also covering at least part of the outside surface of the transparent wall, said third indicia having a pattern that is readily distinguished and easily committed to memory, and a cocoon of transparent material over virtually all of the outside surface of the transparent wall and over the second and third indicia thereon, and said second and third indicia each being at least in part transparent so as to allow viewing therethrough of the underlying first indicia, whereby a parallax is established when looking at the first indicia from an angle through the second and third indicia.

2. A seal combination according to claim 1, wherein the second indicia is in the form of small marks, such as dots, spaced apart from one another.

3. A seal combination according to claim 2, wherein the second indicia marks have an opacity of the order of 10–30% and a transparency of the order of 70–90%.

4. A seal combination according to claim 1, wherein the third indicia is made by halftone printing with many small dots so that even in the areas of highest concentration the dots are spaced apart sufficiently so as to allow some transparency.

5. A seal combination according to claim 4, wherein the third indicia is in the form of human faces.

6. A seal combination according to claim 4, wherein the second indicia is in the form of small marks spaced apart to leave a transparency of the order of 70–90%, and wherein the third indicia is in the form of human faces made by halftone printing with small dots so as to have some transparency itself even in the areas of highest concentration.

7. A seal combination according to claim 1, wherein the cocoon is seamless.

8. A seal combination according to claim 7, wherein the cocoon is formed with nonuniform thickness over the transparent wall.

9. A seal combination according to claim 6, wherein the cocoon is seamless and is formed with nonuniform thickness over the transparent wall.

10. A seal combination according to claim 1, wherein the third indicia is formed on a transparent substrate that overlies the outside surface of the transparent wall and the second indicia thereon.

11. A seal combination according to claim 10, wherein the substrate is formed of material similar to that material with which the cocoon is formed.

12. A seal combination according to either claim 6 or 9, wherein the third indicia is formed on a transparent substrate that overlies the outside surface of the transparent wall and the second indicia thereon, and wherein the substrate is formed of material similar to that material with which the cocoon is formed.

13. A seal combination according to claim 1, further including body means having a hollow and wherein said transparent wall forms part of the body means and closes the hollow, a drum supported within the hollow, means to move the drum unidirectionally relative to the body means through first and second ranges of positions, means activated by the drum and operable in the first range of drum positions to have the seal secured and operable in the second range of drum positions to have a seal opened, said drum and body means defining therebetween a cavity, a plurality of code elements carried within the cavity, said body means having a pocket open to the cavity when the drum is in initial phases of the first range of drum positions operable to receive a small group of the code elements, said drum having first wall means operable in the latter phases of the first range of drum positions to enclose the pocket and thereby trap and hold the group of code elements in the pocket and establish a set code, and said body means having viewing means that in the latter phases of the first range of drum positions is transparent to allow external visual detection of the coded group of code elements.

14. A seal combination according to claim 13, wherein said viewing means includes a window, said drum further having second wall means that in the first range of drum positions overlies the pocket and underlies the window, said second wall means being opaque operative in the initial phases of the first range of drum positions to preclude external viewing through the window of the coded group of code elements.

15. A seal combination according to claim 14, wherein the second indicia is in the form of small marks spaced apart to leave a transparency of the order of 70–90%, and wherein the third indicia is in the form of human faces made by halftone printing with small dots so as to have some transparency itself even in the areas of highest concentration.

16. A seal combination according to claim 15, wherein the cocoon is seamless and is formed with nonuniform thickness over the transparent wall.

17. A seal combination according to any of claims 14, 15, or 16, wherein the third indicia is formed on a transparent substrate that overlies the outside surface of the transparent wall and the second indicia thereon, and wherein the substrate is formed of material similar to that material with which the cocoon is formed.

* * * * *